US006416655B1

(12) United States Patent
Kent et al.

(10) Patent No.: US 6,416,655 B1
(45) Date of Patent: Jul. 9, 2002

(54) SELECTIVE EXTRACTION USING MIXED SOLVENT SYSTEM

(75) Inventors: Christopher J. S. Kent, Paulsboro, NJ (US); Anne M. Zinicola, Houston, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/571,150

(22) Filed: May 15, 2000

Related U.S. Application Data

(60) Provisional application No. 60/145,395, filed on Jul. 23, 1999.

(51) Int. Cl.[7] ..... C10G 21/00

(52) U.S. Cl. ..... 208/87; 208/95; 208/96; 208/97; 208/264; 585/833; 585/835

(58) Field of Search ..... 208/87, 95, 96, 208/97, 264; 585/833, 835

(56) References Cited

U.S. PATENT DOCUMENTS

| | | | | |
|---|---|---|---|---|
| 3,476,681 | A | 11/1969 | Davies et al. | 208/326 |
| 3,929,616 | A | 12/1975 | Mead et al. | 208/87 |
| 4,013,549 | A | 3/1977 | Bushnell | 208/323 |
| 4,125,458 | A | 11/1978 | Bushnell et al. | 208/309 |
| 4,311,583 | A | 1/1982 | Woodle | 208/312 |
| 4,452,708 | A | 6/1984 | Aldrich et al. | 252/8.55 D |
| 4,636,299 | A | 1/1987 | Unmuth et al. | 208/87 |
| 4,770,763 | A | 9/1988 | Kusayanagi et al. | 208/18 |
| 4,909,927 | A | 3/1990 | Bell | 208/326 |
| 5,041,206 | A | 8/1991 | Sequeira, Jr. | 208/87 |
| 5,616,238 | A | 4/1997 | Boyle et al. | 208/314 |
| 5,935,416 | A | 8/1999 | Cody et al. | 208/87 |
| 5,935,417 | A | 8/1999 | Cody et al. | 208/87 |
| 6,099,719 | A | 8/2000 | Cody et al. | 208/87 |

*Primary Examiner*—Nadine Preisch
(74) *Attorney, Agent, or Firm*—James H. Takemoto; Gerard J. Hughes; Paul E. Purwin

(57) ABSTRACT

A method for concentrating the amount of alkylated mono-aromatics in a lubricating oil feedstock useful as a feedstock for sulfonation. The method comprises extracting a feedstock rich in aromatics with a solvent selected from NMP, phenol and furfural, said feedstock containing sufficient water to provide a raffinate having a target VI between about 86 and 97 under extraction conditions of treat and temperature selected to achieve the target VI. The raffinate is then hydrofmed and solvent dewaxed.

12 Claims, No Drawings

SELECTIVE EXTRACTION USING MIXED SOLVENT SYSTEM

This application claims the benefit of provisional application 60/145,395, filed Jul. 23, 1999.

FIELD OF THE INVENTION

This invention relates to the selective extraction of aromatic components from a feedstock using a mixed solvent system. More particularly, mono-aromatic components are selectively extracted from a feed stream using a solvent system containing extraction solvent and water.

BACKGROUND OF THE INVENTION

Petroleum sulfonates are well known as additives to lubricating oil basestocks and as detergents, e.g., in cleaning formulations and personal care products. In some applications, it is desirable to maximize the alkylated mono-aromatic species used in the sulfonation reaction leading to the desired sulfonates.

One approach is to use a blended feed to the sulfonation reaction which feed is selective to the desired sulfonated aromatic species. Another approach is to extract a feedstock with a solvent selective to the desired aromatic species. It is known that NMP is a solvent useful for solvent extraction wherein the raffinate is relatively rich in paraffinic hydrocarbons whereas the extract is relatively rich in aromatic hydrocarbons.

It would be highly desirable to have a solvent system which would selectively concentrate alkylated mono-aromatic hydrocarbons contained in a feed stream while simultaneously rejecting 2+ multi-ring aromatics.

SUMMARY OF THE INVENTION

This invention relates to a method of selectively extracting alkylated mono-aromatic hydrocarbons in a lubricating oil feedstock containing at least about 40 wt. % aromatics by solvent extraction which comprises:

(a) contacting the feedstock with a solvent under solvent extraction conditions, the solvent comprising at least one of N-methyl-2-pyrrolidone, furfural and phenol and a minor amount of water wherein said solvent extraction conditions include the amount of water in the solvent, solvent treat rate and temperature;

(b) separating extracted feedstock into a raffinate rich in paraffinic hydrocarbons and alkylated mono-aromatic hydrocarbons and an extract rich in aromatic hydrocarbons including 2+ multi-ring aromatic hydrocarbons;

(c) removing solvent from the raffinate to produce a stripped raffinate;

(d) hydrofining the stripped raffinate under hydrofining conditions including a temperature of 150 to 450° C., hydrogen pressure of atmospheric to 10,000 psig; and liquid hourly space velocity of 0.1 to 10, (e) solvent dewaxing the hydrofined raffinate under solvent dewaxing conditions to produce a dewaxed hydrofined raffinate; and (f) measuring the VI of the dewaxed hydrofined raffinate and adjusting, if necessary, at least one of the amount of water in the solvent, solvent treat rate and temperature in step (a) to provide a dewaxed hydrofined raffinate having a VI of from about 86 to about 97.

The dewaxed hydrofined raffinate (finished oil from solvent dewaxing) contains at least about 1.5 wt % more alkylated mono-aromatic hydrocarbons than contained in the feedstock.

DESCRIPTION OF THE INVENTION

In the process according to the invention, it has been discovered that adding a minor amount of water to at least one of NMP, furfural and phenol in a solvent extraction process results in concentrating alkylated mono-aromatic species in the feedstock to the solvent extraction zone provided that the amount of water is sufficient to maintain the viscosity index (VI) of the raffinate in the range about 86 to about 97, preferably 88 to 92, under extraction conditions of treat and temperature selected to achieve that VI. Unlike conventional solvent extraction with solvent, the alkylated mono-aromatic are concentrated in the raffinate rather than the extract. Furthermore, multi-ring (2+) aromatics are concentrated in the extract phase. These multi-ring aromatics are undesirable in that they lead to sludge formation upon sulfonation.

Alkylated mono-aromatics contain at least one long chain alkyl moiety on an aromatic ring. Long chain alkyl groups are $C_{12}$ or greater, preferably $C_{14}$ or greater, more preferably $C_{16}$ or greater, most preferably $C_{18}$ or greater. The aromatic ring may also be substituted with short chain alkyl groups provided that there is at least one long chain alkyl group. The mono-aromatic may also contain one or more naphthene rings, e.g., tetralin.

The feedstocks to the solvent extraction zone may be any petroleum feedstock containing at least about 40 wt. % total aromatics, preferably at least about 50 wt. % aromatics, most preferably at least about 55 wt. % aromatics based on feedstock. Such feedstocks include distillates, extracts, raffinates and other feedstocks containing high levels of aromatic compounds.

The solvent extraction process comprises contacting the feedstock with extraction solvent. The extraction solvent can be at least one of NMP, phenol or furfural, and is preferably NMP.

Contacting of the extraction solvent with the feedstock may be conducted using any typical technique common to the industry such as batch contacting or counter-current contacting, preferably counter-current contacting.

Counter-current contacting is conducted in an elongated treating zone or tower, usually vertical. The hydrocarbon feedstock to be extracted is introduced at A. one end of the tower while the selective solvent is introduced at the other. To facilitate separation of the materials in the tower the less dense material is introduced near the bottom of the tower while the more dense material is introduced near the top. In this way the solvent and hydrocarbon are forced to pass counter-currently to each other in the tower while migrating to the end opposite that of their introduction in response to their respective densities. In the cause of such migration the aromatic hydrocarbons are absorbed into the selective solvent.

If NMP is employed as exemplary solvent, the NMP is introduced near the top of the tower while the hydrocarbon feedstock is introduced near the bottom. In this embodiment, the hydrocarbon feedstock is introduced into the tower at a temperature in the range 0° to 200° C., preferably 50° to 150° C., most preferably 75° to 125° C. while the NMP, introduced into the top of the tower is at a temperature in the range 0° to 200° C., preferably about 50° C. to 150° C., most preferably 75° to 125° C.

Counter-current extraction using NMP is typically conducted under conditions such that there is a temperature differential between the top and bottom of the tower of at least about 10° C., preferably at least 15° C.

Overall tower temperature is below the temperature of complete miscibility of oil in solvent.

The extraction solvent is added in a amount within the range of 50 to 500 LV % solvent, preferably 100–300 LV %, most preferably 100 to 250 LV % solvent based on fresh feedstock.

The amount of water which will provide the desired VI range is generally in the range from 0.5 to 10 LV %, preferably 3 to 7 LV %, most preferably 4 to 6 LV %, based on solvent.

The raffinate rich in alkylated mono-aromatics from the extraction step is conducted to a stripping zone where solvent is stripped from the raffinate.

The refractive index (RI) and viscosity index (VI) of the stripped raffinate may be measured and these values may used as a first approximation to control the extraction conditions such that the dewaxed, hydrofined raffinate can be more readily brought into the VI target range.

The stripped raffinate is typically hydrofined after the solvent extraction process. The hydrofining process can be carried out by contacting the feed stream with a catalytically effective amount of a hydrofining catalyst composition and hydrogen under suitable hydrofining conditions. The hydrofining process can be carried out using a fixed catalyst bed, fluidized catalyst bed or a moving catalyst bed. A fixed catalyst bed is preferred. Hydrofining typically removes sulfur and nitrogen polar compounds and results in some saturation of aromatic compounds such as thiophene.

The catalyst composition used in the hydrofining process to remove metals, sulfur, and nitrogen comprises a support and a hydrogenation metal. The support may be a refractory metal oxide, for example, alumina, silica or silica-alumina. The hydrogenation metal comprises at least one metal selected from Group VIB and Group VIII of the Periodic Table. The metal will generally be present in the catalyst composition in the form of an oxide or sulfide. Particularly suitable metals are iron, cobalt, nickel, tungsten, molybdenum, chromium and platinum. Cobalt, nickel, molybdenum and tungsten are the most preferred. A particularly preferred catalyst composition is $Al_2O_3$ promoted by CoO or NiO and $MoO_3$.

Any suitable reaction time between the catalyst composition and the feed stream may be utilized. In general, the reaction time will range from about 0.1 hours to about 10 hours. Preferably, the reaction time will range from about 0.3 to about 5 hours. This generally requires a liquid hourly space velocity (LHSV) in the range of about 0.10 to about 10 cc of oil per cc of catalyst per hour, preferably from about 0.2 to about 3.0 cc/cc/hr.

The temperature will generally be in the range of about 150° C. to about 450° C. and will preferably be in the range of about 300 to about 350° C.

Any suitable hydrogen pressure may be utilized in the hydrofining process. The reaction pressure will generally be in the range of about atmospheric to about 10,000 psig (68,950 kPa). Preferably, the pressure will be in the range of about 500 to about 3,000 psig (3548 to 20651 kPa). The quantity of hydrogen used to contact the feed stock will generally be in the range of about 100 to about 10,000 standard cubic feet per barrel of the feed stream (17.8 to 1780 $m^3/m^3$) and will more preferably be in the range of about 300 to about 1,000 standard cubic feet per barrel (53.4 to 178 $m^3/m^3$).

The hydrofined raffinate is then solvent dewaxed. Solvent dewaxing is well known in the art and may be accomplished using a solvent to dilute the raffinate and chilling to crystallize and separate wax molecules. Typical solvents include at least one of propane, aromatics and ketones. Preferred ketones include methyl ethyl ketone, methyl isobutyl ketone and mixtures thereof. Preferred aromatics are benzene, toluene, and xylene.

It has been discovered that by controlling the amount of water in the extraction solvent and adjusting the extraction conditions of treat and temperature based on amount of water such that the VI of the dewaxed, hydrofined raffinate is in the range from about 86 to about 97,the alkylated mono-aromatics are concentrated in the raffinate phase rather than the extract phase. Multi-ring, i.e., 2+ ring aromatics are concentrated in the extract phase. At a given amount of water in the solvent, increasing the treat rate and extraction temperature will generally increase the VI of the resulting raffinate.

Thus the method according to the invention provides a single stage method for maximizing the concentration of 1–ring aromatics in the raffinate while minimizing the concentration of 2+ multi-ring aromatics without the need of a second extraction. When starting with feedstocks containing at least about 40 wt. % aromatics, the process according to the invention provides finished oils containing at least about 1.5 wt. %, preferably at least about 2 wt. %, more preferably at least about 3 wt. % more mono-aromatics over feed.

The invention is further illustrated by the following non-limiting examples.

EXAMPLES A–G

These examples are directed to illustrating the effects of water content, treat rate and temperature when preparing a dewaxed raffinate in the range of 85 to 97 VI. The feed was a 250N conventional distillate cut boiling in the 700–1100° F. range and was extracted with NMP. The raffinate from NMP extraction was stripped. The raffinate was then solvent dewaxed using a mixture of methyl isobutyl ketone and methyl isobutyl ketone as solvent. The VI of the resulting dewaxed raffinate was then measured. Examples A–G are pilot plant runs designed to simulate actual refinery extraction conditions. The results are shown in Table 1

TABLE 1

Pilot Plant Extractions to Target VI

| Example Number | A | B | C | D | E | F | G |
|---|---|---|---|---|---|---|---|
| Run Number | E4980601 | E4980602 | E4980603 | E4980604 | E4980605 | E4980606 | E4980607 |
| VI Target | 96 | 96 | 91 | 91 | 85 | 85 | 85 |
| Water Content | 5.1 | 0.5 | 2 | 5 | 5 | 7 | 3.1 |
| NMP Treat | 246 | 87 | 98 | 135 | 124 | 209 | 97 |

TABLE 1-continued

| Pilot Plant Extractions to Target VI | | | | | | | | |
|---|---|---|---|---|---|---|---|---|
| Example Number | | A | B | C | D | E | F | G |
| Run Number | | E4980601 | E4980602 | E4980603 | E4980604 | E4980605 | E4980606 | E4980607 |
| NMP/Oil Temp. ° C. | | 80/90 | 50/60 | 50/60 | 80/90 | 60/70 | 60/70 | 45/55 |
| HPLC-2 Analysis | | | | | | | | |
| Saturates, % mass | 46.2 | 20.4 | 71.3 | 64.7 | 65.4 | 61.1 | 61.7 | 61.2 |
| 1R Aromatics, % mass | 19.1 | 20.9 | 20.7 | 22.7 | 22.4 | 22.4 | 22.4 | 22.6 |
| 2R Aromatics, % mass | 16.5 | 6.3 | 6.5 | 8.8 | 9.4 | 12.2 | 12.1 | 12.1 |
| 3R Aromatics, % mass | 8.7 | 0.8 | 0.3 | 1.5 | 1.3 | 2.3 | 2.8 | 2.2 |
| 4R Aromatics, % mass | 6.9 | 0.3 | 0.2 | 0.8 | 0.4 | 09 | 0.4 | 0.8 |
| Total Aromatics | 51.2 | 28.3 | 27.7 | 32.2 | 35.5 | 37.8 | 37.2 | 37.7 |

Examples A and D illustrate the effect of varying treat rate at constant water content and temperature. Lowering the treat rate from 246 (Ex. A) to 135 (Ex. D) resulted in a drop in VI from 96 to 91 and an increase in 1– ring aromatics (20.9% to 22.4%) and total aromatics (28.3% to 35.5%).

Examples D and E illustrate the effect of varying temperature at constant water and approximately constant treat. Lowering the temperature from 80/90 to 60/70 resulted in a drop in VI from 91 to 85 and an increase in undesirable 2– ring aromatics from 9.4 to 12.2%.

Examples B and C illustrate the effect of varying water content of NMP at constant temperature and approximately constant treat. Increasing water from 0.5 LV % (Ex. B) to 2.0 LV % (Ex. C) resulted in an increase in total aromatics from 27.7 to 32.2% and an increase in desirable 1– ring aromatics from 20.7 to 22.7%. Examples C and G are also directed to varying water at approximately constant temperature and treat. In comparing these two Examples, there is noted the same trend of increasing total aromatics. However, 2– ring and greater aromatics went from a total of 11.1 (Ex. C) to 15.1% (Ex. G) even though the 1– ring aromatics were approximately constant.

EXAMPLES H–I

These examples are directed to illustrating the effects of feed, water, treat rate and extraction temperature under operating conditions. In Examples H and I, the feed is a medium heavy distillate similar to the feed of previous examples except that the cut is slightly heavier (a 450 N cut). These examples were extracted and the raffinate measured as above. The results are summarized in Table 2

TABLE 2

| Refinery Runs | H | I |
|---|---|---|
| Extraction Conditions | | |
| Feed, kB/D | 17 | 17 |
| Raffinate, kB/D | 11 | 12.3 |
| Raffinate Yield, % | 64.5 | 72.4 |
| NMP Treat Ratio | 130 | 100 |
| % Wet NMP | 3 | 5.5 |
| Oil NMP Temperature, ° F. | 125/160 | 125/155 |
| Hydrofining Conditions | | |
| Inlet Temperature, ° F. | 575 | 590 |
| Hydrogen Pressure(psig) | 640 | 640 |
| LHSV | 0.85 | 0.95 |

TABLE 2-continued

| Refinery Runs | H | I |
|---|---|---|
| Characteristics | | |
| Specific Gravity, @ 15.6° C. | 0.8805 | 0.866 |
| Viscosity, cSt @ 40° C. | 63.04 | 67.3 |
| cSt @ 100° C. | 8.245 | 8.3 |
| Viscosity Index | 99 | 90 |
| Clay Get Analysis | | |
| Saturates, % mass | 72 | 66.6 |
| Aromatics, % mass | 27.7 | 33 |
| Polars, % mass | 0.5 | 0.4 |
| HPLC Analysis* | | |
| Saturates, % mass | 73.5 | 66.6 |
| Aromatics, 1 ring | 21.8 | 27.4 |
| Aromatics, 2 ring | 3.5 | 4 |
| Aromatics, 3 ring | 0.47 | 0.7 |
| Aromatics, 4+ ring | 0.3 | 0.3 |
| Aromatics, Total | 26.07 | 32.4 |

*High Pressure Liquid Chromatographic

The results in Table 2 demonstrate that by adjusting the amount of water in the NMP and the treat ratio to target a product having a VI of 90 (Ex. I), the amount of mono-aromatics can be increased from 21.8 to 27.4.

What is claimed is:

1. A method of selectively extracting alkylated mono-aromatic hydrocarbons in a lubricating oil feedstock containing at least about 40 wt. % aromatics by solvent extraction which comprises:

(a) contacting the feedstock with a solvent under solvent extraction conditions, the solvent comprising at least one of N-methyl-2-pyrrolidone, furfural and phenol and water wherein said solvent extraction conditions include the amount of water in the solvent, solvent treat rate and temperature;

(b) adjusting at least one of the amount of water in the solvent, solvent treat rate and temperature such that paraffinic hydrocarbons and alkylated mono-aromatic hydrocarbons are concentrated in a raffinate phase;

(c) separating extracted feedstock into a raffinate rich in paraffinic hydrocarbons and alkylated mono-aromatic hydrocarbons and an extract rich in aromatic hydrocarbons including 2+ multi-ring aromatic hydrocarbons;

(d) removing solvent from the raffinate to produce a stripped raffinate;

(e) hydrofining the stripped raffinate under hydrofining conditions including a temperature of 150 to 450° C., hydrogen pressure of atmospheric to 10,000 psig; and liquid hourly space velocity of 0.1 to 10, (f) solvent dewaxing the hydrofined raffinate under solvent dewaxing conditions to produce a dewaxed hydrofined raffinate; and (g) measuring the VI of the dewaxed hydrofined raffinate and adjusting, if necessary, at least one of the amount of water in the solvent, solvent treat rate and temperature in step (a) to provide a dewaxed hydrofined raffinate having a VI of from about 86 to about 97.

2. The method of claim 1 where in solvent is N-methyl-2-pyrrolidone.

3. The method of claim 2 wherein the viscosity index is from about 88 to about 92.

4. The method of claim 1 wherein hydrofining utilizes a catalyst comprising at least one Group VIB or Group VIII metal.

5. The method of claim 4 wherein the catalyst is selected from at least one of cobalt, nickel, molybdenum and tungsten.

6. The method of claim 4 wherein hydrofining utilizes reaction conditions of 0.1 to 10 LHSV, temperature of 150 to 450° C. and hydrogen pressure of atmospheric to 10,000 psig.

7. The method of claim 1 wherein the amount of water is from about 0.5 to 10 LV %.

8. The method of claim 7 wherein the amount of water is from about 3 to 7 LV %.

9. The method of claim 1 wherein the feedstock contains at least about 50 wt. % aromatics.

10. The method of claim 1 wherein the alkylated mono-aromatic contains at least one long chain alkyl group.

11. The method of claim 1 wherein the solvent treat rate is 50–500 LV %, based on amount of feedstock.

12. The method of claim 1 wherein dewaxed hydrofined raffinate contains at least about 1.5 wt % more alkylated mono-aromatic hydrocarbons than contained in the feedstock.

* * * * *